US005194138A

United States Patent [19]

Mansfeld et al.

[11] Patent Number: 5,194,138

[45] Date of Patent: Mar. 16, 1993

[54] METHOD FOR CREATING A CORROSION-RESISTANT ALUMINUM SURFACE

[75] Inventors: Florian B. Mansfeld, Westlake Village, Calif.; Hong Shih, Qingdao; You Wang, Jingshou, both of China

[73] Assignee: The University of Southern California, Los Angeles, Calif.

[21] Appl. No.: 556,109

[22] Filed: Jul. 20, 1990

[51] Int. Cl.[5] ..... C23C 22/56

[52] U.S. Cl. ..... 205/183; 148/241; 148/273; 148/275

[58] Field of Search ..... 148/241, 272, 273, 275; 204/38.1; 205/183

[56] References Cited

U.S. PATENT DOCUMENTS

| | | | |
|---|---|---|---|
| 2,512,493 | 6/1950 | Gide | 148/275 |
| 3,960,676 | 6/1976 | Miyosawa et al. | 204/38.1 |
| 3,969,152 | 7/1976 | Melotik | 148/265 |
| 4,610,732 | 9/1986 | Sasaki et al. | 148/273 |
| 4,992,115 | 2/1991 | Ikeda | 148/261 |

FOREIGN PATENT DOCUMENTS 8806639 9/1988 PCT Int'l Appl. .

OTHER PUBLICATIONS

"The Inhibition of Aluminum Alloy Corrosion by Cerous Cations" by B. R. W. Hinton, Dr. Arnott and N. E. Ryan, *Metals Forum*, vol. 7, No. 4 (1984).

"Cerium Conversion Coatings for the Corrosion Protection of Aluminum" by B. R. W. Hinton, D. R. Arnott and N. E. Ryan, *Materials Forum*, vol. 9, No. 3 (1986).

"Surface Modification of Al Alloys and Al-Based Metal Matrix Composites by Chemical Passivation" by Mansfeld, Lin Kim and Shih; published in *Electrochimica Acta*, vol. 34, No. 8, pp. 1123-1132 (1989).

"Cationic Film Forming Inhibitors for the Protection of 7075 Aluminum Alloy Against Corrosion in Aqueous Chloride Solution" by Hinton and Ryan; published as Paper No. 197 to the Int'l Corrosion Forum Devoted Exclusively to the Protection and Performance of Materials (Mar., 1986).

"Corrosion Protection of Al Alloys and Al-Based Metal Matrix Composites by Chemical Passivation" by Mansfeld, Lin, Kim and Shih; published in *Corrosion*, vol. 45, No. 8, pp. 615-631, Aug. 1989.

*Primary Examiner*—Jay H. Woo
*Assistant Examiner*—James P. Mackey
*Attorney, Agent, or Firm*—Denton L. Anderson

[57] ABSTRACT

A method for treating the surface of an aluminum-based material so as to make the surface resistant to corrosion includes the steps of contacting the surface with an aqueous cerium non-halide solution and then contacting the surface with an aqueous cerium halide solution. These steps may optionally be followed by a step of positively charging the metal surface while in contact with an aqueous molybdenum solution.

42 Claims, No Drawings

METHOD FOR CREATING A CORROSION-RESISTANT ALUMINUM SURFACE

BACKGROUND

This invention relates generally to methods for increasing the corrosion resistance of metals, and specifically to methods of increasing the corrosion resistance of aluminum-based materials and aluminum-containing composites. The invention was made with government support under N00014-88-K-0034 awarded by the Office of Naval Research. The government has certain rights in the invention.

Aluminum-based materials and aluminum-containing composites are known to be relatively resistant to oxidation corrosion. However, such materials are susceptible to pitting corrosion when exposed to acids and halogens. For example, aluminums deteriorate rapidly when exposed to sea water. Even aluminums which are only exposed to the atmosphere will deteriorate with time because of pitting corrosion caused by acidic air pollutants and acid rain.

There are two commonly used methods of increasing the pitting corrosion-resistance of aluminums: anodizing and passivation with chromate solutions. Neither of these methods, however, is wholly satisfactory. Anodizing involves a complex and expensive multi-step procedure. Chromate passivation involves a less complex procedure but does not provide long-term corrosion protection. Chromate passivation, for example, does not provide sufficient pitting corrosion protection to allow aluminum-based materials to be used in marine environments. More importantly, chromates have recently been found to be carcinogenic and can be safely used only under rigidly controlled and expensive procedures. It is believed likely that chromate passivation procedures will be banned altogether within the near future for safety reasons.

It has been recently recommended to provide a corrosion-resistant surface layer on aluminums and other metals by incorporating cerium or other rare earth cations into the aluminum oxide surface film. However, there is no known method in the prior art of incorporating such cations into the surface film in a way which is both rapid (so that the process takes less than several days) and results in a uniformly corrosion-resistant surface.

Accordingly, there is a need for a non-complex method of increasing the corrosion resistance of aluminum-based materials which is superior to presently known methods and which does not require the handling of carcinogens.

There is a further need for a non-complex method of increasing the corrosion resistance of aluminum-based materials for long periods of time, even in severe atmospheres such as in sea water.

SUMMARY OF THE INVENTION

The invention satisfies these needs. The invention is a method for treating the surface of an aluminum-based material so as to make the surface resistant to corrosion. The method comprises the step of contacting the surface with an aqueous rare earth metal solution having a pH between about 4 and about 7 and being at a temperature of at least about 80° C. The surface is contacted with the solution for at least 1 hour.

It is preferred that the rare earth metal be cerium and that the aqueous solution be a solution containing dissolved cerium nitrate or cerium chloride.

In a preferred embodiment of the invention, the method comprises the two steps of contacting the surface with an aqueous cerium non-halide solution followed by contacting the surface with an aqueous cerium halide solution. In each step, the cerium solution has a pH between about 4 and about 7, is at a temperature of at least about 80° C. and is kept in contact with the aluminum surface for at least about 1 hour. In this multi-step embodiment of the invention, it is preferred that the cerium non-halide solution contain cerium nitrate ions and that the cerium halide solution contain cerium chloride ions.

In all embodiments, it is preferred that the rare earth metal solutions have a temperature of at least about 90° C., more preferably at least about 98° C., and most preferably at the solution boiling point. Also in all embodiments, it is preferred that the rare earth metal solutions be in contact with the aluminum surface for at least 1.5 hours and most preferably for at least about 2 hours. Usually, it is unnecessary in the method to contact the surface with either cerium solution for more than about 4 hours.

In embodiments using rare earth metal non-halide solutions, it is preferred that the pH of the solution be between about 4.5 and about 5.5. In embodiments using rare earth metal halide solutions, it is preferred that the pH of the solution be between about 4.5 and about 6.

It is most preferable that the invention comprise the two steps described above followed by the third step of positively charging the surface while maintaining it in contact with an aqueous molybdenum solution. The surface is charged to within the passive region for the aluminum material. The potential must generally be more positive than the corrosion potential of the material. For Al 6061 materials contacted with a 0.1M sodium molybdate solution, the surface can be positively charged to between about 300 mV and about 800 mV above its corrosion potential, preferably between about 400 mV and about 600 mV above its corrosion potential.

The invention has been found to be effective on aluminum surfaces as well as on the surfaces of aluminum metal matrix composite materials.

DETAILED DESCRIPTION

In the previous section, the invention has been generally described. In the present section, several specific embodiments of the invention will be described in detail. This detailed description, however, should not in any way be deemed to limit the scope of the invention more narrowly than that of the appended claims.

The invention can comprise a multi-step process in which the surface of an aluminum-based material is contacted with an aqueous solution containing a rare earth metal for at least about 1 hour, preferably at least about 1.5 hours and most preferably at least about 2 hours. In most cases, excellent results can be achieved by contacting the surface with the solution for about 3 or 4 hours.

Preferably, the solution is an aqueous cerium solution. The solution can be an aqueous cerium nitrate solution. Most preferably, the solution consists essentially of cerium nitrate.

The solution has a pH between about 4 and about 7, preferably between about 4.5 and about 5.5.

The solution is at a temperature of at least about 80° C., preferably at least about 90° C., more preferably at least about 98° C., and most preferably at the boiling temperature of the solution.

It is further preferable that the surface be contacted in a first step with a solution containing ions of a cerium non-halide compound and then contacted in a second step with a solution containing ions of a cerium halide compound. It is preferred that the cerium non-halide solution comprise nitrate ions, and it is most preferred that the cerium non-halide solution consist essentially of cerium nitrate. It is also preferred that the cerium halide solution comprise chloride ions, and it is most preferred that the cerium halide solution consist essentially of cerium chloride.

It is preferred that both the cerium non-halide solution and the cerium halide solution be at a temperature preferably above 80° C., more preferably above 90° C., still more preferably above 98° C., and most preferably at the boiling point of the solution.

The surface is contacted with each of the two cerium solutions for at least about 1 hour, preferably at least about 1.5 hours, and most preferably at least about two hours. As noted above, it is generally not necessary for the surface to be contacted with either solution for more than about 3 or 4 hours.

The pH of the cerium non-halide solution is between about 4 and about 7 and preferably between 4.5 and about 5.5. The pH of the cerium halide solution is between about 4 and about 7 and preferably between about 4.5 and about 6.

In a still more preferred embodiment of the invention, after the surface is contacted with the cerium non-halide solution and the cerium halide solution, as described above, it is positively charged while in contact with an aqueous molybdenum solution. In a typical embodiment, the molybdenum solution is a 0.1M sodium molybdate solution. The surface is charged to within the passive region for the aluminum material. The potential must generally be more positive than the corrosion potential of the material and less positive than the potential at which the molybdenum solution electrochemically decomposes. For Al 6061 materials contacted with 0.1 M sodium molybdate solution, the surface can be positively charged to between about 300 mV and about 800 mV above its corrosion potential, preferably between about 400 mV and about 600 mV above its corrosion potential.

In many cases it has been found to be advantageous to prepare the surface before contacting it with the aqueous rare earth metal solution or solutions. It is generally preferable to clean the solution thoroughly and especially to remove all greases and other organic materials from the surface.

It is also preferable that the surface be thoroughly de-oxidized, such as by being contacted with an appropriate reducing agent, and then be reoxidized such as by being contacted with moist, heated air. A suitable reducing agent is a $H_2SO_4$-$HNO_3$-$H_2SiF_6$ solution. The surface can be suitably reoxidized by exposure to humid, 100° C. air for about 24 hours.

Surfaces treated by the invention, especially by the embodiment of the invention comprising contact with the two different cerium solutions and the molybdenum solution, form a very corrosion-resistant surface on aluminum metals and aluminum matrix composite materials. The corrosion resistance is consistent and uniform throughout the surface. Surfaces treated by the invention have been found to be so corrosion-resistant as to be potentially useful in salt water services.

Surfaces treated by the method of the invention are also smooth and uniform in appearance so that they can be used in architectural and other services where ornamental appearance is an important consideration.

EXAMPLE 1

Samples of Al 6061 and Al 2024 were each subjected to the following procedure:

1. Each sample was degreased using Alconox detergent, rinsed with distilled water to remove the detergent and dried by air. Each was then immersed in hot hexanes at 66° C. for 15 minutes, rinsed with distilled water and dried by air. Each was then placed in an ultrasonic cleaner in acetone at 30° C. for 10 minutes, rinsed with distilled water and dried with air. Finally, each was cleaned a second time with Alconox detergent to remove residual organic reagents, rinsed with distilled water to remove the detergent, dried with air and placed in a desiccator.

2. Each sample was then deoxidized in a $H_2SO_4$-$HNO_3$-$H_2SiF_6$ bath (Aluminum Deoxidizer, Diversey Wyandotte 560) for 10 minutes at room temperature.

3. Each sample was then placed in a high humidity oven at 100° C. for about 24 hours.

4. Each sample was then immersed in a 10 mM cerium nitrate solution at the boiling point of the solution for 2 hours.

5. Each sample was then immersed in a 5 mM cerium chloride solution at the boiling point of the solution for 2 hours.

6. The samples were then tested for corrosion resistance. Both samples showed increased corrosion resistance, with the Al 6061 showing marked increased corrosion resistance.

EXAMPLE 2

Samples of Al 6061, Al 2024 and an aluminum metal matrix composite Al/SiC were each subjected to the following procedure:

1. Each sample was treated in the same way that the samples were treated in steps 1-5 of Example 1.

2. Each sample was then positively charged while immersed in deaerated 0.1M sodium molybdate solution by applying to the sample a constant potential which was 500 mV more positive than the corrosion potential of the sample.

3. Each of the samples was then tested for corrosion resistance. Exceptional corrosion resistance was observed for the Al 6061 and the Al/SiC samples. Each of the samples was exposed to a sodium chloride solution for an extended period of time. The Al 6061 sample showed no signs of pitting after 60 days' exposure. The Al/SiC sample did not show pitting corrosion until after 7 days.

4. The Al 2024 sample showed pitting after 1 day of exposure. This is believed to be due to the high copper content of Al 2024. In an attempt to impart greater corrosion resistance to Al 2024, an ac passivation procedure was designed for the purpose of reducing the copper content at the surface prior to cerium solution passivation, thereby minimizing the aluminum-copper couple which is believed to interfere with the cerium solution passivation process. A potential square wave between −520 mV and −640 mV was applied to a new Al 2024 sample for three days during the sample's exposure to 5 mM cerium chloride solution. A square wave between −610 mV and −640 mV was then applied for another three days. The Al 2024 sample was then exposed to a sodium chloride solution for 35 days. No pitting corrosion was observed.

As noted above, the present invention has been described in considerable detail with reference to certain preferred versions. However, other versions are possible. Therefore, the spirit and scope of the appended claims should not necessarily be limited to the description of the preferred versions contained herein.

What is claimed is:

1. A method for treating the surface of an aluminum-based material so as to make the surface resistant to corrosion, comprising the steps of:

(a) contacting the surface with an aqueous cerium non-halide solution for at least about 1 hour, the cerium non-halide solution having a pH of between about 4 and about 7 and being at a temperature of at least about 80° C.; and (b) contacting the metal surface from step (a) with an aqueous solution consisting essentially of a cerium halide for at least about 1 hour, the cerium halide solution having a pH of between about 4 and about 7 and being at a temperature of at least about 80° C.

2. The method of claim 1 wherein the aqueous cerium non-halide solution comprises nitrate ions.

3. The method of claim 1 wherein the aqueous cerium non-halide solution consists essentially of cerium nitrate.

4. The method of claim 1 wherein the surface is contacted with the aqueous cerium non-halide solution for at least about 1.5 hours.

5. The method of claim 1 wherein the surface is contacted with the aqueous cerium non-halide solution for at least about 2 hours.

6. The method of claim 1 wherein the pH of the cerium non-halide solution is between about 4.5 and about 5.5.

7. The method of claim 1 wherein the temperature of the cerium-non-halide solution is at least about 90° C.

8. The method of claim 1 wherein the temperature of the cerium non-halide solution is at least about 98° C.

9. The method of claim 1 wherein the cerium non-halide solution is at its boiling point.

10. The method of claim 1 wherein the aqueous cerium halide solution comprises chloride ions.

11. The method of claim 1 wherein the surface is contacted with the aqueous cerium halide solution for at least about 1.5 hours.

12. The method of claim 1 wherein the surface is contacted with the aqueous cerium halide solution for at least about 2 hours.

13. The method of claim 1 wherein the pH of the cerium halide solution is between about 4.5 and about 6.

14. The method of claim 1 wherein the temperature of the cerium -halide solution is at least about 90° C.

15. The method of claim 1 wherein the temperature of the cerium halide solution is at least about 98° C.

16. The method of claim 1 wherein the cerium halide solution is at its boiling point.

17. The method of claim 1 comprising the additional step of, after contacting the surface with the cerium non-halide and cerium halide solutions, positively charging the surface while contacting the surface with an aqueous molybdenum solution.

18. The method of claim 17 wherein the aqueous molybdenum solution contains molybdate ions.

19. The method of claim 17 wherein the surface is charged to a potential within the passive region of the aluminum-based material.

20. The method of claim 19 wherein the charge on the surface is between about 300 and about 800 mV above the corrosion potential of the material.

21. The method of claim 19 wherein the surface is charged between about 400 mV and about 600 mV above the corrosion potential of the material.

22. A method for treating a surface of an aluminum-based material so as to make the surface resistant to corrosion, comprising the steps of:

(a) contacting the surface with an aqueous cerium non-halide solution for at least about 1 hours, the cerium non-halide solution having a pH of between about 4 and about 7 and being at a temperature of at least about 80° C.;

(b) contacting the surface from step (a) with an aqueous solution consisting essentially of a cerium halide for at least about 1 hour, the cerium halide solution having a pH of between about 4 and about 7 and being at a temperature of at least about 80° C.; and (c) positively charging the metal surface from step (b) while contacting the surface with an aqueous molybdenum solution.

23. The method of claim 14 wherein the aqueous cerium non-halide solution comprises cerium nitrate.

24. The method of claim 14 wherein the surface is contacted with the aqueous cerium non-halide solution for at least about 1.5 hours.

25. The method of claim 22 wherein the surface is contacted with the aqueous cerium non-halide solution for at least about 2 hours.

26. The method of claim 22 wherein the pH of the cerium non-halide solution is between about 4.5 and about 5.5.

27. The method of claim 22 wherein the temperature of the cerium non-halide solution is at least about 90° C.

28. The method of claim 22 wherein the temperature of the cerium on-halide solution is at least about 98° C.

29. The method of claim 22 wherein the cerium non-halide solution is at its boiling point.

30. The method of claim 22 wherein the aqueous cerium halide solution comprises cerium chloride.

31. The method of claim 22 wherein the surface is contacted with the aqueous cerium halide solution for at least about 1.5 hours.

32. The method of claim 22 wherein the surface is contacted with the aqueous cerium halide solution for at least about 2 hours.

33. The method of claim 22 wherein the pH of the cerium halide solution is between about 4.5 and about 6.

34. The method of claim 22 wherein the temperature of the cerium halide solution is at least about 90° C.

35. The method of claim 22 wherein the temperature of the cerium halide solution is at least about 98° C.

36. The method of claim 22 wherein the cerium halide solution is at its boiling point.

37. The method of claim 22 wherein the surface is charged to a potential within the passive region of the aluminum-based material.

38. The method of claim 22 wherein the charge on the surface is between about 300 and about 800 mV.

39. The method of claim 22 wherein the surface is charged between about 400 mV and about 600 mV.

40. The method of claims 1 or 22 wherein the surface consists essentially of aluminum.

41. The method of claims 13 or 22 wherein the surface comprises an aluminum metal matrix composite.

42. The method of claims 1 or 35 comprising the further steps of, prior to performing step (a), removing metal oxides from the surface and then reoxidizing the metal surface to create a uniform aluminum oxide layer on the surface.

* * * * *